US010145595B2

(12) United States Patent
Tomita et al.

(10) Patent No.: US 10,145,595 B2
(45) Date of Patent: Dec. 4, 2018

(54) REFRIGERATION CYCLE APPARATUS

(71) Applicant: Mitsubishi Electric Corporation, Tokyo (JP)

(72) Inventors: Masafumi Tomita, Tokyo (JP); Kazuki Okada, Tokyo (JP); Masanori Aoki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 280 days.

(21) Appl. No.: 14/872,549

(22) Filed: Oct. 1, 2015

(65) Prior Publication Data

US 2016/0146521 A1 May 26, 2016

(30) Foreign Application Priority Data

Nov. 21, 2014 (JP) ..... 2014-236744

(51) Int. Cl.
*F25B 49/00* (2006.01)
*F25B 13/00* (2006.01)
*F25B 49/02* (2006.01)

(52) U.S. Cl.
CPC ..... *F25B 49/005* (2013.01); *F25B 13/00* (2013.01); *F25B 49/022* (2013.01); *F25B 2313/006* (2013.01); *F25B 2313/02741* (2013.01); *F25B 2313/0314* (2013.01); *F25B 2500/01* (2013.01); *F25B 2500/222* (2013.01);
(Continued)

(58) Field of Classification Search
CPC ..... F25B 49/005; F25B 49/022; F25B 13/00; F25B 2313/02741; F25B 2700/2106
See application file for complete search history.

(56) References Cited

U.S. PATENT DOCUMENTS 4,711,394 A * 12/1987 Samuel ..... F24F 3/0442 165/209
5,651,263 A * 7/1997 Nonaka ..... F25B 9/006 62/205
2009/0126375 A1* 5/2009 Toyoshima ..... F25B 45/00 62/77

FOREIGN PATENT DOCUMENTS

EP 1 970 651 A1 9/2008
EP 1970651 A1 * 9/2008 ..... F25B 49/005
(Continued)

OTHER PUBLICATIONS

Kubota et al., Refrigerating/Air Conditioning System . . . , Sep. 17, 2008, EP1970651A1 , Whole Document.*
(Continued)

*Primary Examiner* — Larry Furdge
(74) *Attorney, Agent, or Firm* — Posz Law Group, PLC

(57) ABSTRACT

A refrigeration cycle apparatus includes a refrigerant circuit connecting a compressor, a heat source-side heat exchanger, an expansion device, and a use-side heat exchanger to each other by connecting pipes, an outside air temperature sensor configured to detect an outside air temperature, and a controller configured to operate the refrigeration cycle apparatus and to switch between a normal operation mode for controlling the refrigerant circuit based on an operation load of the use-side heat exchanger and a refrigerant amount determining mode for determining whether or not an amount of refrigerant in the refrigerant circuit is appropriate. The controller is configured to switch the normal operation mode to the refrigerant amount determining mode when the outside air temperature detected by the outside air temperature sensor is within a set temperature range.

10 Claims, 7 Drawing Sheets

(52) U.S. Cl.
CPC ..... *F25B 2500/23* (2013.01); *F25B 2500/24* (2013.01); *F25B 2700/04* (2013.01); *F25B 2700/15* (2013.01); *F25B 2700/2106* (2013.01)

(56) References Cited

FOREIGN PATENT DOCUMENTS

| | | | | |
|---|---|---|---|---|
| EP | 2 088 391 | A2 | | 8/2009 |
| JP | 2005-098642 | A | | 4/2005 |
| JP | 2006-023072 | A | | 1/2006 |
| JP | 2009-079842 | A | | 4/2009 |
| JP | 2009079842 | A | * | 4/2009 |
| JP | 2010-007997 | A | | 1/2010 |
| WO | 2008/035418 | A1 | | 3/2008 |

OTHER PUBLICATIONS

Tanaka et al., Refrigerating Cycle Device and its Control Method, Apr. 16, 2009, JP2009079842A, Whole Document.*
Office Action dated Feb. 21, 2017 issued in the corresponding JP patent application No. 2014-236744 (and English translation).
Extended European Search Report dated May 2, 2016 issued in corresponding EP patent application No. 15194356.0.
Office Action dated Aug. 2, 2017 issued in corresponding CN patent application No. 201510802189.0 (and English translation).
Office Action dated Dec. 15, 2017 issued in corresponding CN patent application No. 201510802189.0 (and English translation).

* cited by examiner

REFRIGERATION CYCLE APPARATUS

TECHNICAL FIELD

The present invention relates to a refrigeration cycle apparatus having a function of determining whether or not an amount of refrigerant filled in a refrigerant circuit is appropriate.

BACKGROUND ART

Hitherto, there has been known a separate-type refrigeration cycle apparatus in which a heat source unit and a use unit are connected to each other through connecting pipes, to thereby form a refrigerant circuit. In such a refrigeration cycle apparatus, refrigerant leakage may occur due to insufficient tightening at a pipe connecting position, damage on the pipes, or other factors. The refrigerant leakage may cause reduction in cooling capacity or heating capacity of the refrigeration cycle apparatus, or cause damage on component devices. Further, when the amount of refrigerant filled in the refrigeration cycle apparatus is insufficient, the desired cooling capacity or heating capacity may not be obtained.

In view of this problem, there is known a refrigeration cycle apparatus having a function of determining whether or not the amount of refrigerant filled in the refrigeration cycle apparatus is appropriate. For example, in Patent Literature 1, there is proposed a configuration in which a reference value of an operation state amount obtained when the refrigeration cycle apparatus is operated with a defined refrigerant amount (or an initially enclosed refrigerant amount) is stored in advance in a storage unit, and the reference value and a value of a current operation state amount are compared to each other, to thereby determine whether or not the amount of the filled refrigerant is appropriate.

CITATION LIST

Patent Literature

Patent Literature 1: Japanese Unexamined Patent Application Publication No. 2009-79842 (see FIG. 1 and FIG. 15)

SUMMARY OF INVENTION

Technical Problem

The refrigeration cycle apparatus disclosed in Patent Literature 1 has a configuration in which whether or not the refrigerant amount is appropriate is periodically determined in a time period in which air conditioning is not required, such as on holidays or in the middle of the night. However, when whether or not the refrigerant amount is appropriate is determined in a time period in which air conditioning is not used, it is necessary to drive the refrigeration cycle apparatus only for the determination on whether or not the refrigerant amount is appropriate. As a result, power is consumed although the air conditioning capacity is unnecessary, increasing the electricity charges. Further, when the refrigerant amount is determined during a period in which the air conditioning capacity is necessary, such as midsummer or midwinter, the air conditioning capacity required by the user may not be sufficiently exerted, disturbing the comfortability. Still further, when refrigerant leakage is found as a result of determining the refrigerant amount during the period in which the air conditioning capacity is necessary, such as midsummer or midwinter, it is necessary to stop the refrigeration cycle apparatus for repair, inspection, or other operations. In this case, air cannot be conditioned during the period in which the air conditioning is necessary.

The present invention has been made to solve the above-mentioned problems, and has an object to provide a refrigeration cycle apparatus capable of lowering power consumption and determining whether or not the refrigerant amount is appropriate without disturbing the comfortability.

Solution to Problem

A refrigeration cycle apparatus of the present invention includes a refrigerant circuit connecting a compressor, a heat source-side heat exchanger, an expansion device, and a use-side heat exchanger to each other by connecting pipes, an outside air temperature sensor configured to detect an outside air temperature, and a controller configured to operate the refrigeration cycle apparatus and to switch between a normal operation mode for controlling the refrigerant circuit based on an operation load of the use-side heat exchanger and a refrigerant amount determining mode for determining whether or not an amount of refrigerant in the refrigerant circuit is appropriate. The controller is configured to switch the normal operation mode to the refrigerant amount determining mode when the outside air temperature detected by the outside air temperature sensor is within a set temperature range.

Advantageous Effects of Invention

According to the refrigeration cycle apparatus of the present invention, the refrigerant amount determining mode is performed during a period in which less air conditioning load is required based on the outside air temperature. Thus, the comfortability of the user is not disturbed. Further, when the refrigerant is leaking, services may be executed prior to a period in which the air conditioning capacity is necessary, such as midsummer or midwinter. Further, the frequency of the performance of the refrigerant amount determining mode may be reduced, and hence the power consumption is lowered.

DESCRIPTION OF EMBODIMENTS

Figure 1:
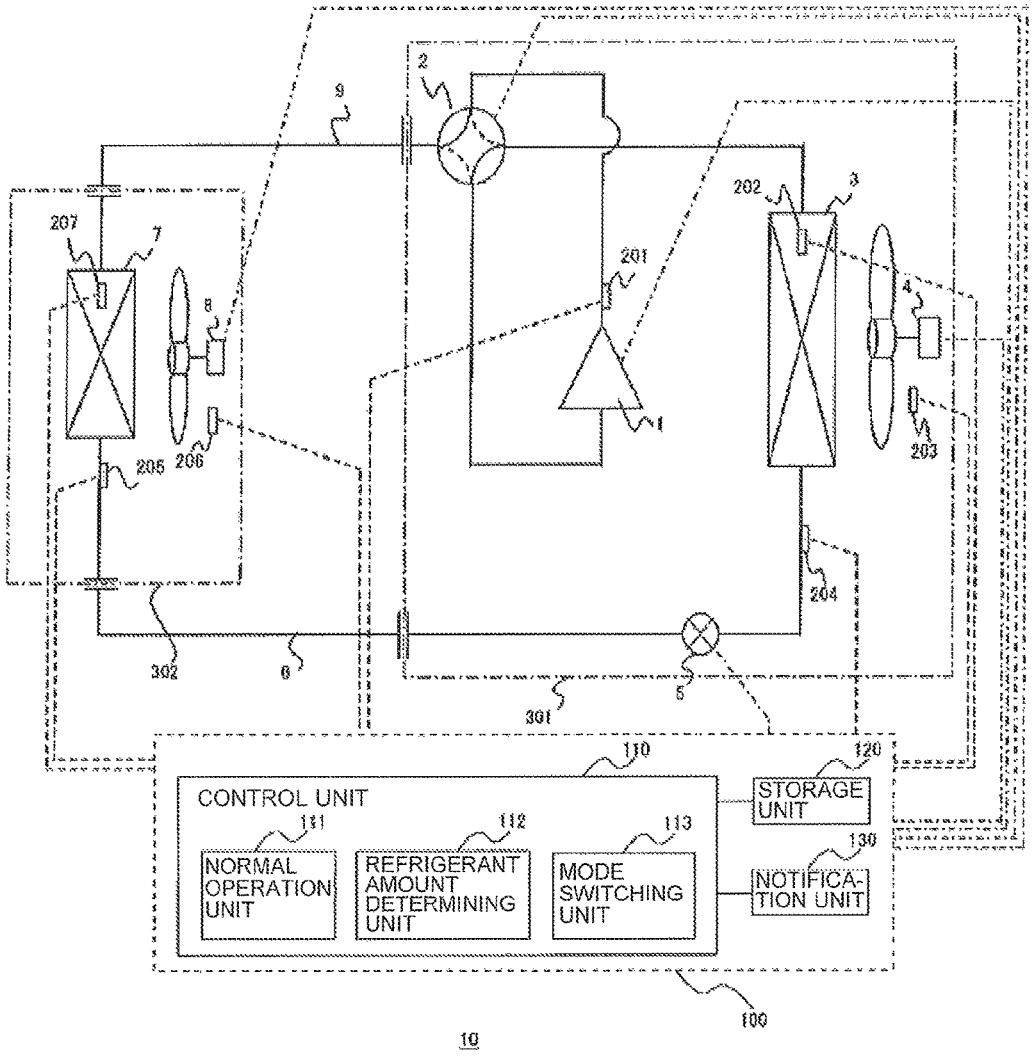
FIG. 1 is a schematic structural diagram of a refrigeration cycle apparatus according to an embodiment of the present invention.

A refrigeration cycle apparatus according to an embodiment of the present invention is described below in detail with reference to the drawings. FIG. 1 is a schematic structural diagram of a refrigeration cycle apparatus 10 according to this embodiment of the present invention. The refrigeration cycle apparatus 10 according to this embodiment is an apparatus to be used for indoor air conditioning (cooling and heating) for performing a vapor-compression refrigeration cycle operation. The refrigeration cycle apparatus 10 includes a heat source unit 301, a use unit 302 connected in parallel to the heat source unit 301 through a liquid connecting pipe 6 and a gas connecting pipe 9, and a controller 100 for controlling the heat source unit 301 and the use unit 302. The heat source unit 301 and the use unit 302 are connected to each other through the liquid connecting pipe 6 and the gas connecting pipe 9, to thereby form a refrigerant circuit of the refrigeration cycle apparatus 10.

Note that, in this embodiment, as illustrated in FIG. 1, there is described a case where one use unit 302 is connected to one heat source unit 301, but the number of the respective units is not particularly limited. For example, two or more use units 302 connected in parallel may be connected to the heat source unit 301, or two or more heat source units connected in parallel may be provided. Examples of the refrigerant to be used in the refrigeration cycle apparatus 10 include HFC refrigerants such as R410A, R407C, R404A, and R32, HCFC refrigerants such as R22 and R134a, and natural refrigerants such as hydrocarbon, helium, and propane.

<Heat Source Unit>

The heat source unit 301 is an outdoor unit to be installed outdoors. The heat source unit 301 is connected to the use unit 302 through the liquid connecting pipe 6 and the gas connecting pipe 9, to thereby form a part of the refrigerant circuit. Next, the detailed configuration of the heat source unit 301 is described. The heat source unit 301 includes a compressor 1, a flow switching device 2, a heat source-side heat exchanger 3, an outdoor air-sending device 4, and an expansion device 5.

The compressor 1 is, for example, a positive displacement compressor to be driven by a motor (not shown) controlled by an inverter. The operation capacity of the compressor 1 is variably controlled by the controller 100. Note that, in the example of FIG. 1, only one compressor 1 is provided, but the present invention is not limited thereto. Two or more compressors 1 may be connected in parallel depending on the number of the use units 302 to be connected or other factors.

The flow switching device 2 includes, for example, a four-way valve for switching the refrigerant flow direction. During a cooling operation, as indicated by the dotted lines in FIG. 1, the flow switching device 2 connects the discharge side of the compressor 1 and the heat source-side heat exchanger 3 to each other, and connects the suction side of the compressor 1 and the gas connecting pipe 9 to each other. With this configuration, the heat source-side heat exchanger 3 is allowed to function as a condenser of the refrigerant compressed by the compressor 1, and a use-side heat exchanger 7 is allowed to function as an evaporator of the refrigerant condensed by the heat source-side heat exchanger 3. Further, during a heating operation, as indicated by the solid lines in FIG. 1, the flow switching device 2 connects the discharge side of the compressor 1 and the gas connecting pipe 9 to each other, and connects the suction side of the compressor 1 and the heat source-side heat exchanger 3 to each other. With this configuration, the use-side heat exchanger 7 is allowed to function as the condenser of the refrigerant compressed by the compressor 1, and the heat source-side heat exchanger 3 is allowed to function as the evaporator of the refrigerant condensed in the use-side heat exchanger 7. The switching of the flow passages by the flow switching device 2 is controlled by the controller 100.

The gas side of the heat source-side heat exchanger 3 is connected to the flow switching device 2, and the liquid side thereof is connected to the liquid connecting pipe 6. The heat source-side heat exchanger 3 is, for example, a cross-fin fin-and-tube heat exchanger including heat transfer tubes and many fins. The heat source-side heat exchanger 3 functions as the condenser of the refrigerant during the cooling operation, and functions as the evaporator of the refrigerant during the heating operation.

The outdoor air-sending device 4 is a fan for supplying air to the heat source-side heat exchanger 3. The outdoor air-sending device 4 includes, for example, a propeller fan to be driven by a DC fan motor (not shown), and has a function of sucking outdoor air into the heat source unit 301 and discharging air subjected to heat exchange with the refrigerant by the heat source-side heat exchanger 3 outdoors. The flow rate of air supplied by the outdoor air-sending device 4 is variably controlled by the controller 100.

The expansion device 5 is arranged on the liquid side of the heat source unit 301 to control the flow rate of the refrigerant flowing through the refrigerant circuit, for example. The expansion device 5 has a function as a pressure reducing valve or an expansion valve, and the opening degree (throttling) thereof is controlled by the controller 100.

Further, the heat source unit 301 has various sensors installed thereon. In detail, a discharge temperature sensor 201 for detecting a discharge temperature Td is provided to the compressor 1. Further, on the gas side of the heat source-side heat exchanger 3, there is provided a gas-side temperature sensor 202 for detecting the temperature of the refrigerant in a two-phase gas-liquid state (refrigerant temperature corresponding to a condensing temperature Tc during the cooling operation or refrigerant temperature corresponding to an evaporating temperature Te during the heating operation). Further, on the liquid side of the heat source-side heat exchanger 3, there is provided a liquid-side temperature sensor 204 for detecting the temperature of the refrigerant in a liquid or two-phase gas-liquid state (refrigerant temperature corresponding to a condenser outlet temperature (liquid temperature) Tco during the cooling operation or refrigerant temperature corresponding to the evaporating temperature Te during the heating operation). Further, on the outdoor air suction port side of the heat source unit 301, there is provided an outside air temperature sensor 203 for detecting a temperature of outdoor air flowing into the heat source unit 301 as an outside air temperature Ta. The temperatures detected by the discharge temperature sensor 201, the gas-side temperature sensor 202, the liquid-side temperature sensor 204, and the outside air temperature sensor 203 are output to the controller 100.

<Use Unit>

The use unit 302 is an indoor unit to be installed on the indoor ceiling by being embedded, suspended, or the like, or installed on the indoor wall surface by being wall-mounted or the like. As described above, the use unit 302 is connected to the heat source unit 301 through the liquid connecting pipe 6 and the gas connecting pipe 9, to thereby form a part of the refrigerant circuit.

Next, the detailed configuration of the use unit 302 is described. The use unit 302 forms an indoor-side refrigerant circuit, which is a part of the refrigerant circuit, and includes an indoor air-sending device 8 and the use-side heat exchanger 7.

The use-side heat exchanger 7 is, for example, a cross-fin fin-and-tube heat exchanger including heat transfer tubes and many fins. The use-side heat exchanger 7 functions as the evaporator of the refrigerant during the cooling operation to cool the indoor air, and functions as the condenser of the refrigerant during the heating operation to heat the indoor air.

The indoor air-sending device 8 is a fan for supplying air to the use-side heat exchanger 7. The indoor air-sending device 8 includes a centrifugal fan and a multiblade fan to be driven by a DC fan motor (not shown), for example. The indoor air-sending device 8 is used to suck indoor air into the use unit 302, and supply air subjected to heat exchange with the refrigerant at the use-side heat exchanger 7 indoors as supply air. The flow rate of air supplied by the indoor air-sending device 8 is variably controlled by the controller 100.

Further, the use unit 302 has various sensors installed thereon. In detail, on the liquid side of the use-side heat exchanger 7, there is provided a liquid-side temperature sensor 205 for detecting the temperature of the refrigerant in a liquid or two-phase gas-liquid state (refrigerant temperature corresponding to the condenser outlet temperature (liquid temperature) Tco during the heating operation or refrigerant temperature corresponding to the evaporating temperature Te during the cooling operation). Further, on the gas side of the use-side heat exchanger 7, there is provided a gas-side temperature sensor 207 for detecting the temperature of the refrigerant in a two-phase gas-liquid state (refrigerant temperature corresponding to the condensing temperature Tc during the heating operation or refrigerant temperature corresponding to the evaporating temperature Te during the cooling operation). Further, on the indoor air suction port side of the use unit 302, there is provided an indoor temperature sensor 206 for detecting the temperature of indoor air flowing into the unit. Note that, the liquid-side temperature sensor 205, the gas-side temperature sensor 207, and the indoor temperature sensor 206 each include, for example, a thermistor, but the present invention is not limited thereto. The temperatures detected by the liquid-side temperature sensor 205, the gas-side temperature sensor 207, and the indoor temperature sensor 206 are output to the controller 100.

<Controller>

Next, the detailed configuration of the controller 100 is described. The controller 100 controls each unit of the refrigeration cycle apparatus 10, and includes a microcomputer or a digital signal processor (DSP).

The controller 100 includes a control unit 110, a storage unit 120, and a notification unit 130. Further, the control unit 110 includes a normal operation unit 111, a refrigerant amount determining unit 112, and a mode switching unit 113. The normal operation unit 111, the refrigerant amount determining unit 112, and the mode switching unit 113 are realized by functional blocks realized by executing a program, or are realized by electronic circuits such as an application specific IC (ASIC).

The controller 100 controls the refrigeration cycle apparatus 10 to operate in a normal operation mode for controlling the refrigerant circuit based on the operation load of the use-side heat exchanger 7 or in a refrigerant amount determining mode for determining whether or not the refrigerant amount is appropriate. Note that, the normal operation mode includes the cooling operation and the heating operation. The normal operation mode and the refrigerant amount determining mode are switched by the mode switching unit 113 of the control unit 110 based on the operation state of the refrigeration cycle apparatus 10 and the outside air temperature Ta.

In the normal operation mode, the normal operation unit 111 controls each device of the heat source unit 301 and the use unit 302 based on the operation load of the use unit 302. In detail, based on the temperatures detected by the various temperature sensors, the normal operation unit 111 controls the compressor 1, the flow switching device 2, the outdoor air-sending device 4, the expansion device 5, and the indoor air-sending device 8 so that these devices are driven within a desired control target range. Further, the calculation result of the operation state amount (such as a degree of superheat or a degree of subcooling), which is obtained by the normal operation unit 111, is stored in the storage unit 120.

In the refrigerant amount determining mode, the refrigerant amount determining unit 112 determines whether or not the refrigerant amount is appropriate. In detail, the refrigerant amount determining unit 112 compares a reference operation state amount (such as a degree of subcooling), which is stored in the storage unit 120, with a current operation state amount (such as a degree of subcooling). When the current operation state amount is equal to or less than the reference operation state amount, the refrigerant amount determining unit 112 determines that the refrigerant is leaking or the like. The mode switching unit 113 switches between the normal operation mode and the refrigerant amount determining mode based on the operation state of the refrigeration cycle apparatus 10 and the outside air temperature Ta.

The storage unit 120 stores the calculation result of the operation state amount (such as a degree of superheat or a degree of subcooling) obtained by the normal operation unit 111, and the reference operation state amount (such as a degree of subcooling) collected in advance based on an appropriate refrigerant amount. The notification unit 130 indicates the determination result of the refrigerant amount determining unit 112 on a remote control of the refrigeration cycle apparatus 10, an LED provided on the heat source unit 301, a remote monitor, or the like, to thereby notify the user of the result.

Next, the operations in the normal operation mode and the refrigerant amount determining mode of the refrigeration cycle apparatus 10 according to this embodiment are described.

<Normal Operation Mode>

First, the cooling operation in the normal operation mode is described. During the cooling operation, the flow switching device 2 is in a state indicated by the dotted lines in FIG. 1, that is, in a state in which the discharge side of the compressor 1 is connected to the heat source-side heat exchanger 3 and the suction side of the compressor 1 is connected to the use-side heat exchanger 7. Further, the opening degree of the expansion device 5 is controlled by the normal operation unit 111 of the control unit 110 so that the degree of superheat of the refrigerant on the suction side of the compressor 1 is a predetermined value. In this embodiment, the degree of superheat of the refrigerant on the suction side of the compressor 1 can be obtained by subtracting the evaporating temperature Te of the refrigerant detected by the gas-side temperature sensor 207 from a suction temperature Ts of the compressor 1. In this case, the suction temperature Ts of the compressor 1 can be calculated by the following expression (1). In the following expression (1), Ps represents a low-pressure-side saturation pressure converted based on the evaporating temperature Te of the refrigerant detected by the gas-side temperature sensor 207, and Pd represents a high-pressure-side saturation pressure converted based on the condensing temperature Tc of the refrigerant detected by the gas-side temperature sensor 202. Further, Td represents a refrigerant discharge temperature detected by the discharge temperature sensor 201 of the compressor 1, and the compression process of the compressor 1 is assumed as a polytropic change with a polytropic index n.

[Math. 1]

$$Ts = Td\left[\frac{Ps}{Pd}\right]^{\frac{n-1}{n}} \quad (1)$$

In this case, Ts and Td each represent a temperature [K], Ps and Pd each represent a pressure [MPa], and n represents a polytropic index [–]. The polytropic index may be a constant value (for example, n=1.2), but when the polytropic index is defined as a function of Ps and Pd, the suction temperature Ts of the compressor 1 can be estimated with higher accuracy.

Note that, in the above, the pressure Pd and the pressure Ps are converted based on the condensing temperature Tc and the evaporating temperature Te of the refrigerant, respectively, but the respective pressures may be obtained by directly adding a pressure sensor to each heat exchanger. Further, also the suction temperature Ts may be obtained by directly adding a temperature sensor or a pressure sensor on the suction side of the compressor 1.

When the compressor 1, the outdoor air-sending device 4, and the indoor air-sending device 8 are activated under a state in which the expansion device 5 is controlled as described above, a low-pressure gas refrigerant is sucked into the compressor 1 to be compressed and become a high-pressure gas refrigerant. After that, the high-pressure gas refrigerant passes through the flow switching device 2 to be sent to the heat source-side heat exchanger 3, and exchanges heat with the outdoor air supplied by the outdoor air-sending device 4 to be condensed and become a high-pressure liquid refrigerant.

Then, the high-pressure liquid refrigerant is reduced in pressure by the expansion device 5 to become a low-temperature and low-pressure two-phase gas-liquid refrigerant, and passes through the liquid connecting pipe 6 to be sent to the use unit 302. The sent refrigerant exchanges heat with the indoor air in the use-side heat exchanger 7 to be evaporated and become a low-pressure gas refrigerant. At this time, the air subjected to heat exchange in the use-side heat exchanger 7 is cooled. In this case, the expansion device 5 controls the flow rate of the refrigerant flowing through the use-side heat exchanger 7 so that the degree of superheat on the suction side of the compressor 1 is a predetermined value. Thus, the low-pressure gas refrigerant evaporated in the use-side heat exchanger 7 is in a state with a predetermined degree of superheat. As described above, the refrigerant flows through the use-side heat exchanger 7 in a flow rate based on the operation load required in an air-conditioned space in which the use unit 302 is installed. The low-pressure gas refrigerant evaporated in the use-side heat exchanger 7 passes through the gas connecting pipe 9 to be sent to the heat source unit 301, and passes through the flow switching device 2 to be sucked into the compressor 1 again.

Next, the heating operation in the normal operation mode is described. During the heating operation, the flow switching device 2 is in a state indicated by the solid lines in FIG. 1, that is, in a state in which the discharge side of the compressor 1 is connected to the use-side heat exchanger 7 and the suction side of the compressor 1 is connected to the heat source-side heat exchanger 3. Further, the opening degree of the expansion device 5 is controlled by the normal operation unit 111 of the control unit 110 so that the degree of superheat of the refrigerant on the suction side of the compressor 1 is a predetermined value. In this embodiment, the degree of superheat of the refrigerant on the suction side of the compressor 1 can be obtained by subtracting the evaporating temperature Te of the refrigerant detected by the gas-side temperature sensor 202 from the suction temperature Ts of the compressor 1. In this case, the suction temperature Ts can be calculated by the expression (1) above. In the expression (1) above, Ps represents a low-pressure-side saturation pressure converted based on the evaporating temperature Te of the refrigerant detected by the gas-side temperature sensor 202, and Pd represents a high-pressure-side saturation pressure converted based on the condensing temperature Tc of the refrigerant detected by the gas-side temperature sensor 207. Further, Td represents a refrigerant discharge temperature detected by the discharge temperature sensor 201 of the compressor 1, and the compression process of the compressor 1 is assumed as a polytropic change with a polytropic index n.

Note that, similarly to the cooling operation, the pressure Pd and the pressure Ps may be obtained by directly adding a pressure sensor to each heat exchanger. Further, also the suction temperature Ts may be obtained by directly adding a temperature sensor or a pressure sensor on the suction side of the compressor 1.

When the compressor 1, the outdoor air-sending device 4, and the indoor air-sending device 8 are activated under a state in which the expansion device 5 is controlled as described above, a low-pressure gas refrigerant is sucked into the compressor 1 to be compressed and become a high-pressure gas refrigerant, and passes through the flow switching device 2 and the gas connecting pipe 9 to be sent to the use unit 302.

Then, the high-pressure gas refrigerant sent to the use unit 302 exchanges heat with the indoor air in the use-side heat exchanger 7, to thereby be condensed and become a high-pressure liquid refrigerant. After that, the refrigerant passes through the liquid connecting pipe 6 to be reduced in pressure by the expansion device 5 and become a refrigerant in a low-pressure two-phase gas-liquid state. At this time, the air subjected to heat exchange in the use-side heat exchanger 7 is heated. In this case, the expansion device 5 controls the flow rate of the refrigerant flowing through the use-side heat exchanger 7 so that the degree of superheat on the suction side of the compressor 1 is a predetermined value. Thus, the high-pressure liquid refrigerant condensed in the use-side heat exchanger 7 is in a state with a predetermined degree of subcooling. As described above, the refrigerant flows through the use-side heat exchanger 7 in a flow rate based on the operation load required in the air-conditioned space in which the use unit 302 is installed.

The refrigerant reduced in pressure by the expansion device 5 to become a low-pressure two-phase gas-liquid state flows into the heat source-side heat exchanger 3 of the heat source unit 301. Then, the refrigerant in the low-pressure two-phase gas-liquid state flowing into the heat source-side heat exchanger 3 exchanges heat with the outdoor air supplied by the outdoor air-sending device 4 to be condensed and become a low-pressure gas refrigerant, and passes through the flow switching device 2 to be sucked into the compressor 1 again.

<Refrigerant Amount Determining Mode>

Next, the operation including refrigerant amount determining processing in the refrigerant amount determining mode is described. In the following, a case where a heating flow passage is set is described as an example. When the heating flow passage is set, the refrigerant circuit is switched so that the flow switching device 2 of the heat source unit 301 is in a state indicated by the solid lines in FIG. 1. Then, a high-pressure gas refrigerant compressed by and discharged from the compressor 1 is supplied to a flow passage from the compressor 1 to the use-side heat exchanger 7. This high-pressure gas refrigerant passes through the gas connecting pipe 9 and exchanges heat with the indoor air while passing through the use-side heat exchanger 7 functioning as the condenser, to thereby become a high-pressure refrigerant changed in phase from a gas state to a liquid state. Then, the refrigerant flows as a high-pressure liquid refrigerant through a flow passage from the use-side heat exchanger 7 to the expansion device 5, including the liquid connecting pipe 6. This high-pressure liquid refrigerant exchanges heat with the outdoor air while passing from the expansion device 5 through the heat source-side heat exchanger 3 functioning as the evaporator, to thereby change its phase from a two-phase gas-liquid state to a gas state. Thus, the refrigerant becomes a low-pressure gas refrigerant to flow through a flow passage from the heat source-side heat exchanger 3 to the compressor 1.

Next, the operation state amount of the refrigeration cycle apparatus 10 is measured, such as environmental conditions including the outside air temperature and the indoor air temperature, the temperatures of the respective units in the heat source unit 301 and the use unit 302, the operation frequency of the compressor 1, and the opening degree of the expansion device 5.

During the refrigerant amount determining mode, a refrigerant amount determining operation is performed for stabilizing the state of the refrigerant circulating through the refrigerant circuit. Specifically, there are performed a constant rotation speed control for setting the rotation speed of the motor of the compressor 1 constant at a predetermined value, and a constant degree-of-superheat control for setting a degree of superheat SH of the heat source-side heat exchanger 3 functioning as the evaporator constant at a predetermined value. In this case, the constant rotation speed control is performed to stabilize the flow rate of the refrigerant to be sucked and discharged by the compressor 1. Further, the constant degree-of-superheat control is performed to set the refrigerant amount constant in the heat source-side heat exchanger 3. With this configuration, the state of the refrigerant circulating through the refrigerant circuit is stabilized, and the refrigerant amount in devices and pipes other than the use-side heat exchanger 7 becomes substantially constant.

Next, the detailed control method during the refrigerant amount determining mode is described.

<Constant Connecting Pipe Refrigerant Density Control>

Figure 2:
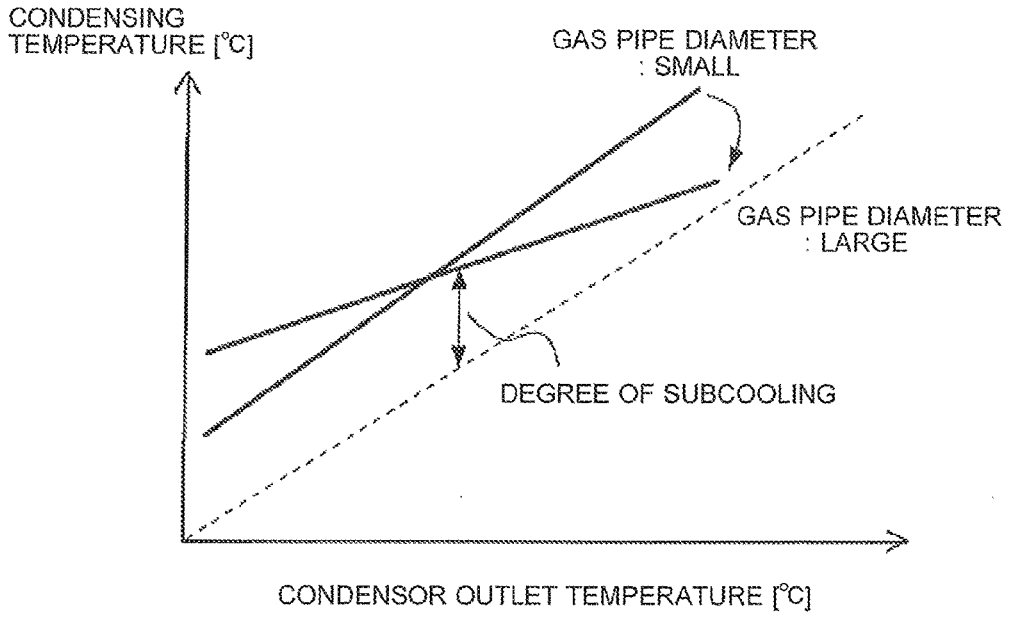
FIG. 2 is a graph showing a relationship between a condenser outlet liquid temperature and a condensing temperature for obtaining a constant refrigerant density in a connecting pipe of the refrigeration cycle apparatus according to the embodiment of the present invention.

A constant connecting pipe refrigerant density control for controlling the refrigerant density to be constant in the liquid connecting pipe 6 and the gas connecting pipe 9 is described. FIG. 2 is a graph showing a relationship between a condenser outlet liquid temperature and a condensing temperature for obtaining a constant refrigerant density in the connecting pipe of the refrigeration cycle apparatus 10. In detail, FIG. 2 shows the relationship between the condensing temperature and the condenser outlet liquid temperature for obtaining a constant refrigerant density in the liquid connecting pipe 6 and the gas connecting pipe 9 when a pipe diameter of the liquid connecting pipe 6 is fixed, while the gas pipe diameter of the gas connecting pipe 9 is varied. As shown in FIG. 2, when the condensing temperature is equal to the liquid temperature (in a case indicated by the dotted straight line in FIG. 2), the degree of subcooling is 0, and thus the degree of subcooling cannot be secured. As the pipe diameter of the gas connecting pipe 9 is increased with respect to the pipe diameter of the liquid connecting pipe 6, the tilt of the straight line representing the equal density is decreased. That is, for example, when the liquid temperature rises and the refrigerant density in the liquid connecting pipe 6 is decreased, it is necessary to increase the refrigerant density of the gas connecting pipe 9, and hence it is necessary to increase the condensing temperature to increase the pressure. As the pipe diameter of the gas connecting pipe 9 is relatively increased with respect to the pipe diameter of the liquid connecting pipe 6, the condensing temperature is only required to be increased in a small amount.

To improve the accuracy of determination of the refrigerant amount, it is essential to set the refrigeration cycle in the same state regardless of the length and the pipe diameter of the connecting pipe. In addition, it is necessary to eliminate influences of the connecting pipe on increase and decrease of the refrigerant amount. In this regard, it is only required to control the condensing temperature to be a target value based on the condenser outlet liquid temperature as in FIG. 2 depending on the combination of the liquid connecting pipe 6 and the gas connecting pipe 9. In this case, as a method of causing the condensing temperature to approach a desired condensing temperature, controlling the rotation speed of the compressor 1 can control the condensing temperature. When the condensing temperature is smaller than the target value, the rotation speed is increased to increase the condensing temperature, and when the condensing temperature is larger than the target value, the rotation speed of the compressor 1 is decreased to decrease the condensing temperature.

Note that, the rotation speed of the compressor 1 is herein controlled while assuming the condensing temperature determined based on the condenser outlet liquid temperature as the target value, but the high pressure of the refrigerant in the gas connecting pipe 9 may be directly controlled based on the condenser outlet liquid temperature. As a method of detecting the high pressure, for example, a pressure sensor (not shown) may be provided on the discharge side of the compressor 1 to detect the high-pressure-side pressure of the refrigerant.

<Constant Heat Source Unit Refrigerant Density Control>

Figure 3:
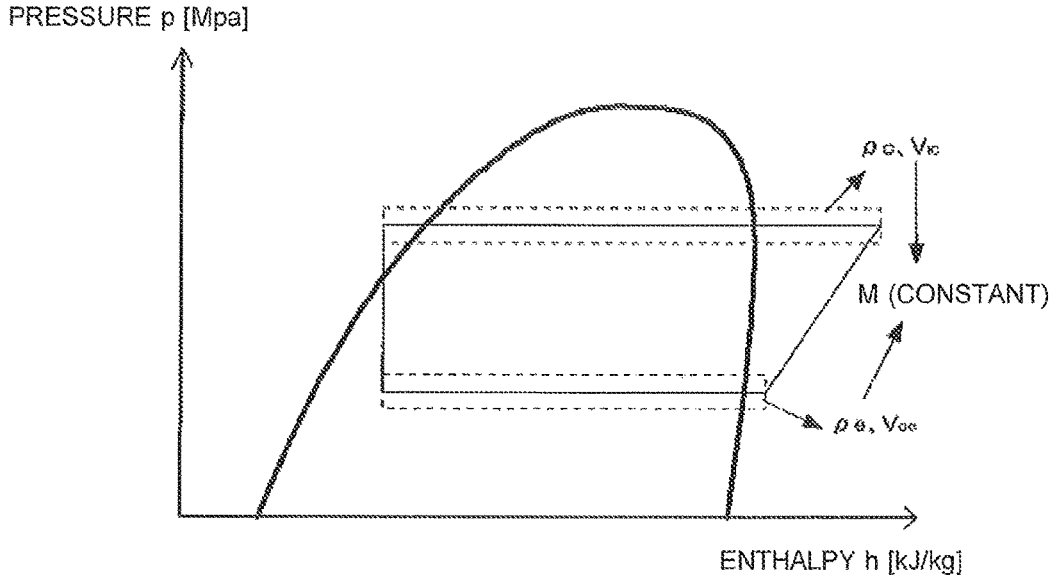
FIG. 3 is a p-h diagram of the refrigeration cycle apparatus according to the embodiment of the present invention.

A constant heat source unit refrigerant density control for controlling the amount of the refrigerant existing in the heat source unit 301 to be constant is described. FIG. 3 is a p-h diagram of the refrigeration cycle apparatus 10. Assuming that the refrigerant existing in the liquid connecting pipe 6 and the gas connecting pipe 9 is filled based on the length and the pipe diameter of the pipes, as shown in FIG. 3, when $V_{OC}$ represents the internal volume of the heat source unit 301 and $V_{IC}$ represents the internal volume of the use unit 302, the following expression (2) is satisfied during the heating operation.

$$\rho e \times V_{OC} + \rho c \times V_{IC} = M \text{ (constant)} \quad (2)$$

In this case, ρe represents an evaporating-side average refrigerant density [kg/m$^3$], ρc represents a condensing-side average refrigerant density [kg/m$^3$], and M represents a total refrigerant amount [kg] of the condensing side and the evaporating side. In the expression (2), M is a value determined based on a total of the internal volume of the heat source unit 301 and the internal volume of the use unit 302, which is a constant value when an appropriate refrigerant amount is determined. Although $V_{OC}$ differs depending on the capacity of the heat source unit 301, when the value of ρe is controlled to be constant and the amount of the refrigerant existing in the heat source unit 301 is maintained constant, even if $V_{IC}$, which is determined based on the number and volume of the use units to be connected, is unknown, it is only required to control ρc for obtaining an appropriate refrigerant amount as a target value.

Figure 4:
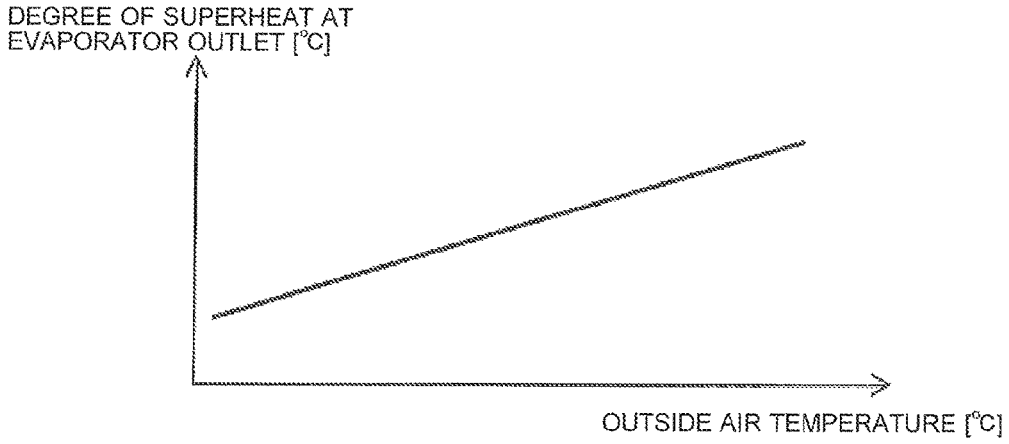
FIG. 4 is a graph showing a relationship between an outside air temperature and a degree of superheat when the refrigerant density is constant in a heat source unit of the refrigeration cycle apparatus according to the embodiment of the present invention.

Next, a method of controlling ρe to be constant, that is, controlling the amount of the refrigerant existing in the heat source unit 301 to be constant, is described. The heat source unit 301 is the evaporator, and the amount of the refrigerant existing in the evaporator can be controlled by changing the opening degree of the expansion device 5. FIG. 4 is a graph showing a relationship between the outside air temperature and the degree of superheat when the refrigerant density is constant in the heat source unit 301 of the refrigeration cycle apparatus 10. In FIG. 4, the lateral axis represents an outside air temperature, and there is indicated the degree of superheat at the outlet of the heat source-side heat exchanger 3, that is, on the suction side of the compressor 1 when the refrigerant density of the heat source unit 301 is constant (the amount of the existing refrigerant is constant). As is clear from FIG. 4, to maintain the refrigerant density of the heat source unit 301 constant, the degree of superheat is controlled based on the outside air temperature. Further, as the outside air temperature is increased, it is necessary to control the degree of superheat to be increased. This is because, as the outside air temperature is increased, the evaporating temperature is increased, and the average density of the two-phase gas-liquid part of the refrigerant is increased. Consequently, it is necessary to increase a superheated gas region with a low refrigerant density of the evaporator to maintain the average density constant.

Thus, to control the refrigerant density of the heat source unit 301 to be constant, it is only required to set the target value of the degree of suction superheat of the compressor 1 shown in FIG. 4 based on the temperature measured by the outside air temperature sensor 203, and control the degree of suction superheat by the expansion device 5. As a method of causing the degree of superheat on the suction side of the compressor 1 to approach a desired degree of superheat, controlling the opening degree of the expansion device 5 can control the degree of superheat. When the degree of superheat is smaller than the target value, the opening degree is increased, and when the degree of superheat is larger than the target value, the opening degree is decreased. Further, the refrigerant amount determining mode is periodically used, and hence the target value of the degree of suction superheat of the compressor 1 is fixed. Thus, through setting of a condition for entering the refrigerant amount determining mode within a certain outside air temperature range, every change in operation state is decreased, leading to improvement in refrigerant amount detection accuracy.

Note that, in this case, the degree of superheat on the suction side of the compressor 1 can be calculated by the above-mentioned method with use of the condensing temperature, the evaporating temperature, and the discharge temperature, and hence it is only required to control the degree of suction superheat based on the outside air temperature sensor 203. Alternatively, the degree of suction superheat may be obtained as a value obtained by subtracting the value of the liquid-side temperature sensor 204 from the value of the gas-side temperature sensor 202 of the heat source-side heat exchanger 3. With such a control, the refrigerant is gasified at an intermediate position of the heat source-side heat exchanger 3, and hence the average density of the heat source unit 301 is decreased, and the refrigerant is liable to be accumulated in the use unit 302. Further, the degree of subcooling in the use-side heat exchanger 7, which has a large correlation with the refrigerant amount, can be easily secured, and hence there is an effect in that the refrigerant amount can be detected earlier.

<Determination on Whether or not Refrigerant Amount is Appropriate>

Figure 5:
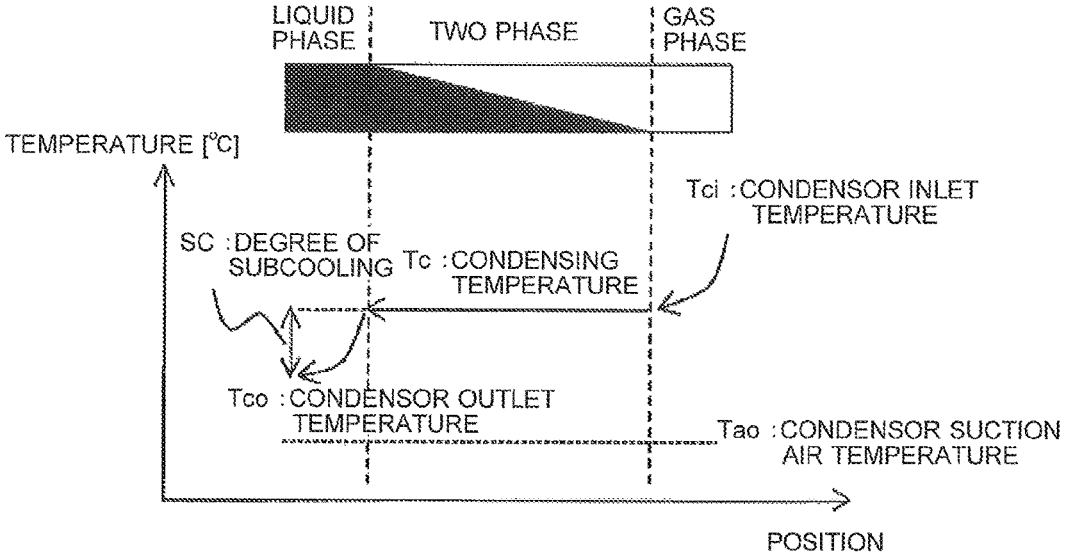
FIG. 5 is a diagram illustrating a change in refrigerant temperature inside a condenser of the refrigeration cycle apparatus according to the embodiment of the present invention.

FIG. 5 is a diagram illustrating the change in refrigerant temperature inside the condenser of the refrigeration cycle apparatus 10. As illustrated in FIG. 5, a gas refrigerant temperature Tci at the condenser inlet is cooled by a condenser suction air temperature Tao, is condensed through latent heat change by the condensing temperature Tc, and is further cooled to become a liquid refrigerant temperature Tco at the condenser outlet. The degree of subcooling SC here is a value obtained by subtracting the liquid refrigerant temperature Tco at the condenser outlet from the condensing temperature Tc. It is understood from this temperature change that the refrigerant amount at the outlet of the use-side heat exchanger 7, that is, the average refrigerant density of the condenser has a correlation with the degree of subcooling SC representing the refrigerant amount that the liquid phase occupies.

Figure 6:
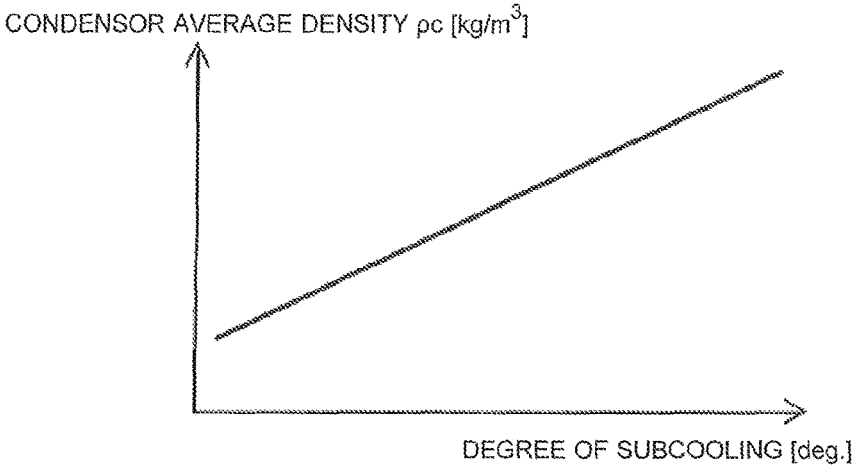
FIG. 6 is a graph showing a relationship between a degree of subcooling of refrigerant and an average refrigerant density inside the condenser in the refrigeration cycle apparatus according to the embodiment of the present invention.

FIG. 6 is a graph showing a relationship between the degree of subcooling SC of the refrigerant and the average refrigerant density inside the condenser in the refrigeration cycle apparatus 10. In detail, FIG. 6 shows the relationship among the appropriate refrigerant amount, the degree of subcooling SC when the refrigerant amount is increased relative to the appropriate refrigerant amount (for example, increased by 10%), and the average refrigerant density pc of the condenser when the indoor and outdoor air conditions are varied. As shown in FIG. 6, it is understood that, as the refrigerant amount is decreased (that is, as the degree of subcooling SC is decreased), the average refrigerant density of the condenser, that is, the refrigerant amount that the liquid phase occupies in the condenser is decreased.

In this embodiment, the storage unit 120 stores the value of the degree of subcooling SC at the outlet of the use-side heat exchanger 7 (hereinafter referred to as "reference value SCr"), which corresponds to the average refrigerant density ρc of the condenser when the refrigeration cycle apparatus 10 enters the refrigerant amount determining mode for the first time after being installed. With this configuration, during the refrigerant amount determining mode performed for the next or subsequent time, the reference value SCr of the degree of subcooling SC and a current value SCp of the degree of subcooling SC detected during the refrigerant amount determining mode are compared to each other. Thus, whether or not the refrigerant amount is appropriate can be determined. Note that, in another embodiment, when a plurality of use units 302 are provided, an average value of the degrees of subcooling SC of the respective use units may be obtained.

As described above, through determination on whether or not the refrigerant amount is appropriate, even when the amount of the refrigerant filled on site varies, or when the reference value of the operation state amount to be used for determination on whether or not the refrigerant amount satisfies the defined refrigerant amount is varied depending on the pipe length and diameter of the refrigerant communication pipe or the combination of the use units having a plurality of capacities, whether or not the refrigerant amount filled in the refrigeration cycle apparatus 10 is appropriate can be determined with good accuracy.

<Switching of Operation Mode>

Figure 7:
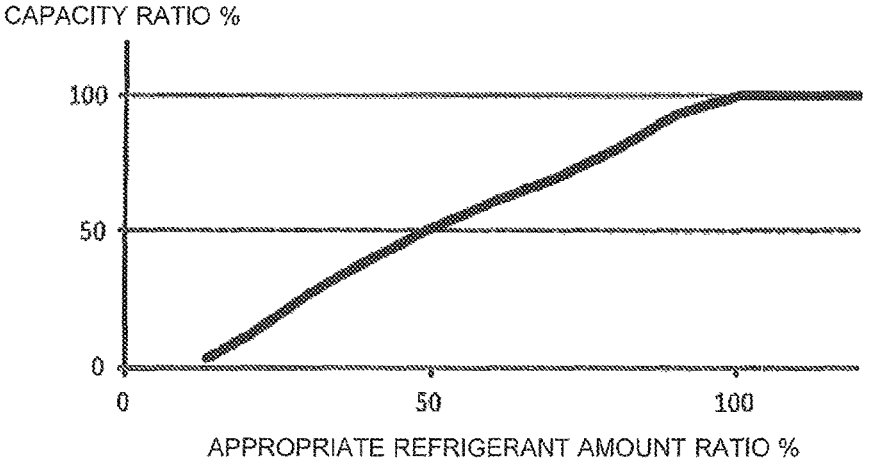
FIG. 7 is a graph showing a relationship between a refrigerant amount and an air conditioning capacity in the refrigeration cycle apparatus according to the embodiment of the present invention.

FIG. 7 is a graph showing a relationship between the refrigerant amount and the air conditioning capacity in the refrigeration cycle apparatus 10. As shown in FIG. 7, when the refrigerant leaks and the appropriate refrigerant amount is not satisfied, sufficient air conditioning capacity cannot be exerted. Further, when, in the refrigerant amount determining mode, the above-mentioned refrigerant amount determination operation (constant connecting pipe refrigerant density control and constant heat source unit refrigerant density control) is performed, the air conditioning capacity required by a user as the refrigeration cycle apparatus 10 cannot be exerted.

Figure 8:
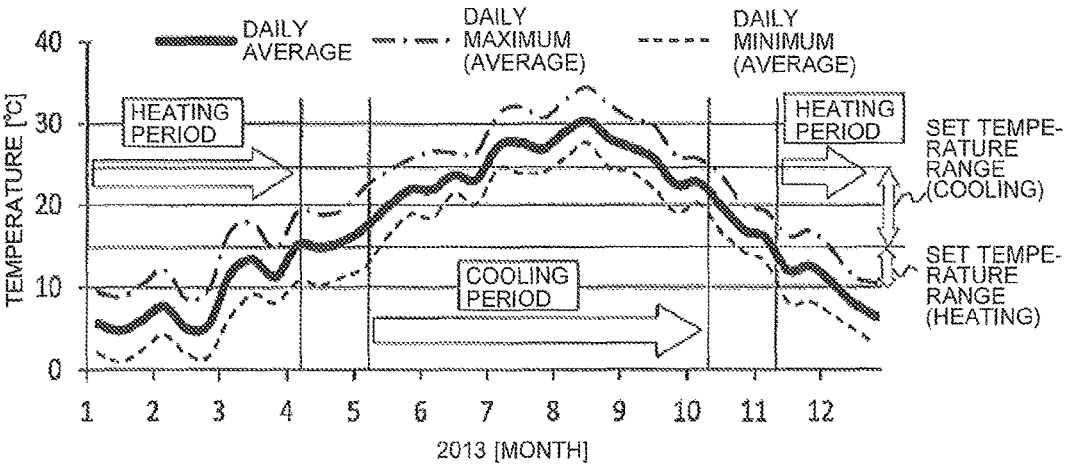
FIG. 8 is a graph showing an example of an annual temperature change in Tokyo.
Figure 9:
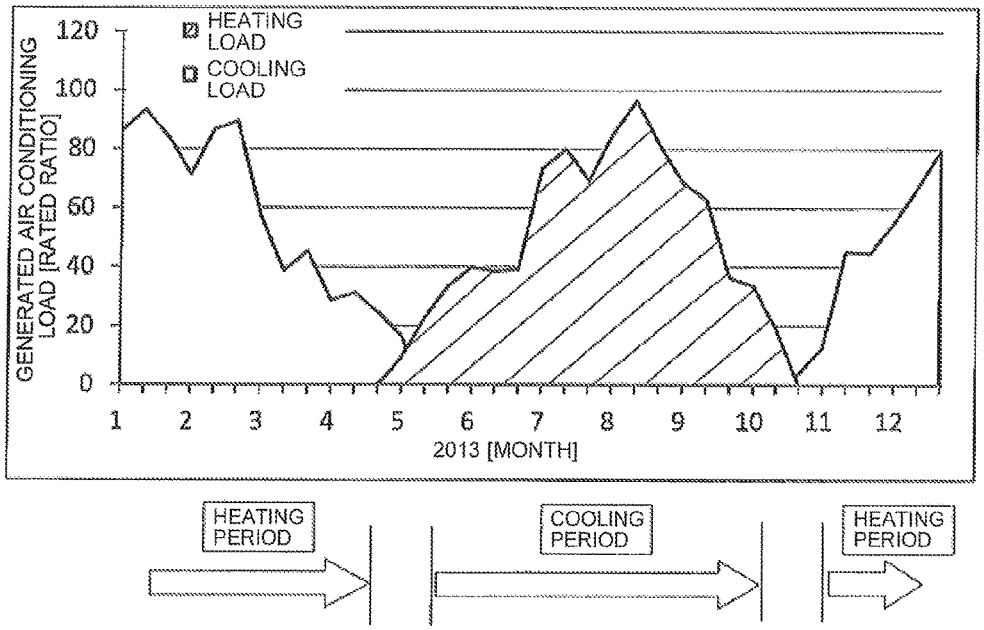
FIG. 9 is a graph showing an example of an annual air conditioning load change in Tokyo.

FIG. 8 is a graph showing an example of an annual temperature change in Tokyo. FIG. 9 is a graph showing an example of an annual air conditioning load change in Tokyo, and is a graph obtained by converting the temperature in FIG. 8 into the air conditioning load defined in JISB8616. As shown in FIG. 8 and FIG. 9, the cooling or heating air conditioning capacity is necessary in midsummer (July to September) or midwinter (December to February). Thus, when the refrigerant amount determining mode is performed in midsummer or midwinter, sufficient air conditioning capacity cannot be exerted, which may disturb the comfortability of the user. Further, when the refrigerant is leaking, the air conditioning capacity cannot be exerted during the normal operation.

Further, when the refrigerant amount determining mode is performed at night or on holidays not to disturb the comfortability of the user, the refrigeration cycle apparatus 10 is operated under a situation where the user does not require the air conditioning. Thus, unnecessary power is consumed, and unnecessary charges are required.

In view of this problem, in this embodiment, when the air conditioning capacity is relatively unnecessary, that is, when the air conditioning load is small, the refrigerant amount determining mode is performed to determine whether or not the refrigerant amount is appropriate. In this case, the air conditioning start period defined in JISB8616 is May for cooling and November for heating. As shown in FIG. 9, the air conditioning load is small at the start of the cooling season (May) and at the start of the heating season (November). The air conditioning capacity necessary at the start of the cooling season (May) is 50% or less, and the air conditioning capacity necessary at the start of the heating season (November) is 50% or less. Thus, the mode switching unit 113 determines the switching to the refrigerant amount determining mode based on the outside air temperature of May, which is the cooling season start period, and the outside air temperature of November, which is the heating season start period. Thus, whether or not the refrigerant amount is appropriate can be determined in an environment with a relatively small air conditioning load.

Specifically, as temperature ranges, a range of from 15 degrees C. to 25 degrees C. is set as the outside air temperature of May, which is a cooling season start period, and a range of from 10 degrees C. to 15 degrees C. is set as the outside air temperature of November, which is a heating season start period, and the temperature ranges are stored in the storage unit 120. The mode switching unit 113 switches the operation mode to the refrigerant amount determining mode when the outside air temperature Ta detected by the outside air temperature sensor 203 is within the set temperature range stored in the storage unit 120. Further, to determine whether or not the cooling or heating start period has arrived, the mode switching unit 113 performs switching based on the outside air temperature immediately after the switching from cooling to heating or immediately after the switching from heating to cooling.

Figure 10:
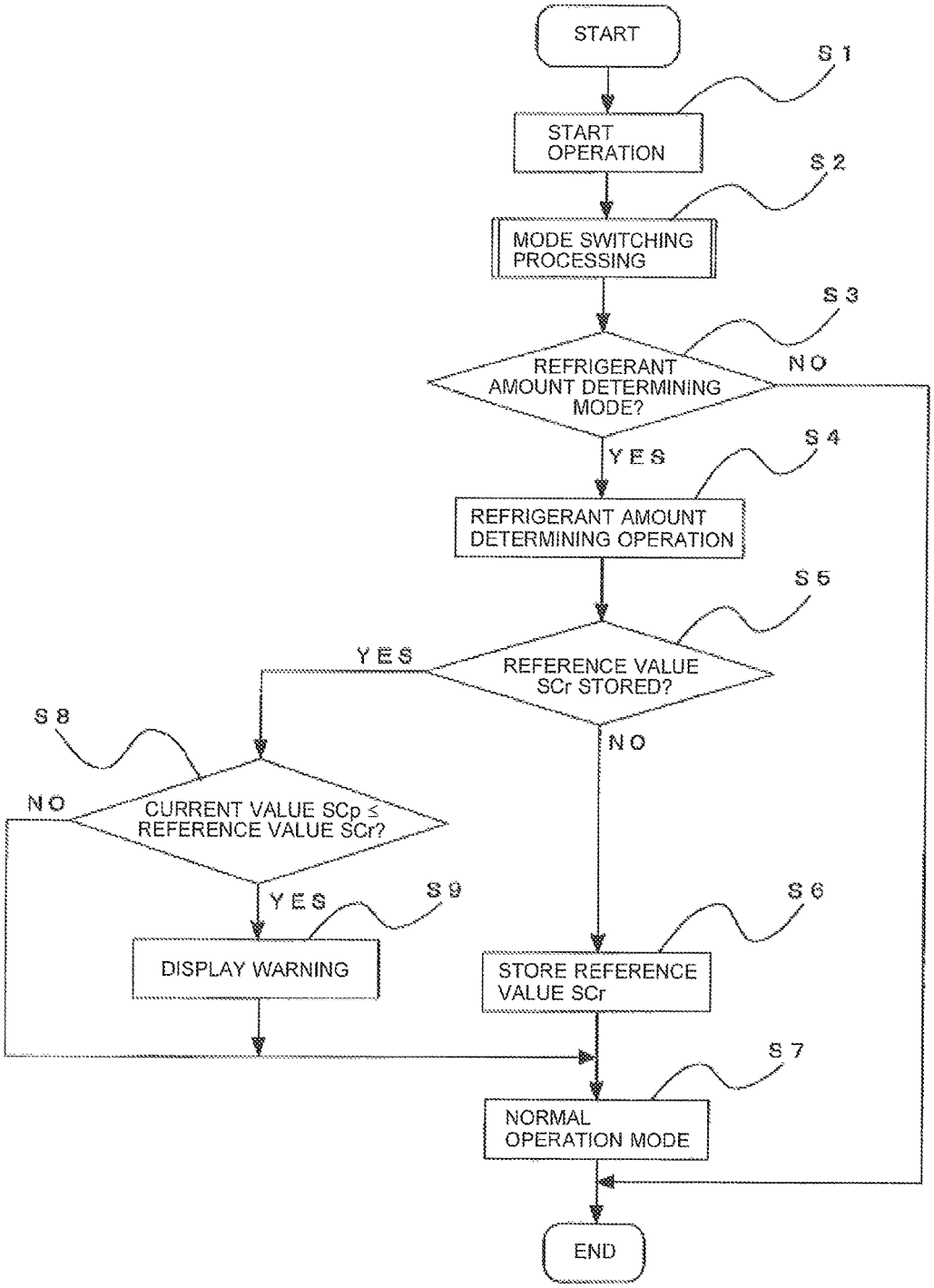
FIG. 10 is a flow chart of refrigerant amount determining processing of the refrigeration cycle apparatus according to the embodiment of the present invention.
Figure 11:
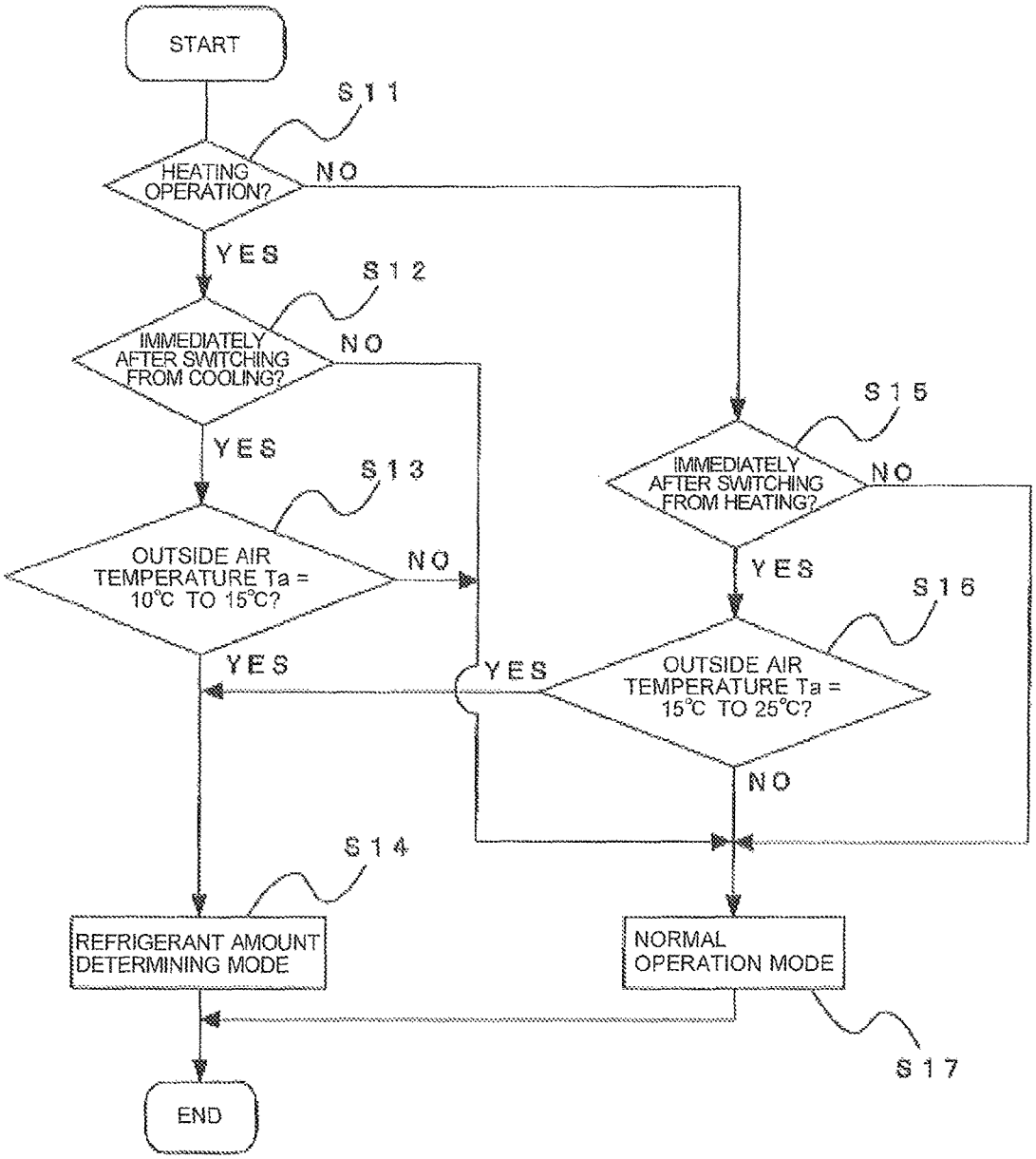
FIG. 11 is a flow chart of mode switching processing of the refrigeration cycle apparatus according to the embodiment of the present invention.

FIG. 10 is a flow chart illustrating the refrigerant amount determining processing in the refrigeration cycle apparatus 10 of this embodiment. This processing is performed by the refrigerant amount determining unit 112 of the controller 100. In this processing, first, the user instructs the refrigeration cycle apparatus 10 to start the operation (S1). At this start of the operation, the normal operation mode is set as an initial mode, and the user specifies the heating operation or the cooling operation. Then, the mode switching unit 113 performs the mode switching processing (S2). FIG. 11 is a flow chart of the mode switching processing in the refrigeration cycle apparatus 10. As illustrated in FIG. 11, in this processing, first, whether or not the operation is the heating operation is determined (S11). Then, when the operation is the heating operation (S11: YES), it is determined whether or not it is immediately after the switching from the cooling (S12). In this case, it is determined whether or not the previous operation is the cooling operation. As described above, whether or not it is immediately after the switching from the cooling is determined to determine whether or not it is the heating season start period, which requires a relatively small air conditioning load.

Then, when it is immediately after the switching from the cooling (S12: YES), it is determined whether or not the outside air temperature Ta is from 10 degrees C. to 15 degrees C. (S13). In this case, the outside air temperature Ta is the detection temperature of the outside air temperature sensor 203. Further, the range of from 10 degrees C. to 15 degrees C. corresponds to a temperature range set in advance as an outside air temperature of November, which is a heating season start period, and is stored in the storage unit 120. As described above, it is determined whether or not the outside air temperature Ta is within the set temperature range of the heating start period, to thereby determine whether or not it is an environment having a relatively small air conditioning load.

Then, when the outside air temperature Ta is from 10 degrees C. to 15 degrees C. (S13: YES), the operation mode is switched to the refrigerant amount determining mode (S14). On the other hand, when it is not immediately after the switching from the cooling (S12: NO), or when the outside air temperature Ta is not from 10 degrees C. to 15 degrees C. (S13: NO), the operation mode is maintained at the normal operation mode (S17). As described above, when it is determined that it is not an environment having a relatively small air conditioning load, the normal operation in the normal mode is performed without switching to the refrigerant amount determining mode.

On the other hand, when the operation is not the heating operation (S11: NO), it is determined that the operation is the cooling operation, and then it is determined whether or not it is immediately after the switching from the heating (S15). Then, when it is immediately after the switching from the heating (S15: YES), it is determined whether or not the outside air temperature Ta is from 15 degrees C. to 25 degrees C. (S16). In this case, the range of from 15 degrees C. to 25 degrees C. corresponds to a temperature range set in advance as an outside air temperature of May, which is a cooling season start period, and is stored in the storage unit 120. Then, when the outside air temperature Ta is from 15 degrees C. to 25 degrees C. (S16: YES), the refrigerant amount determining mode is set (S14). On the other hand, when it is not immediately after the switching from the heating (S15: NO), or the outside air temperature Ta is not from 15 degrees C. to 25 degrees C. (S16: NO), the normal operation mode is maintained (S17). As described above, also during the cooling operation, similarly to during the heating operation, the air conditioning load is estimated based on switching of the operation mode and the outside air temperature Ta, and the operation mode is switched to the refrigerant amount determining mode or the normal operation mode is maintained.

After the mode switching processing is finished, the process returns to the refrigerant amount determining processing of FIG. 10, and it is determined whether or not the operation mode is the refrigerant amount determining mode (S3). Then, when the operation mode is not the refrigerant amount determining mode (S3: NO), this processing is finished, and the normal operation in the normal operation mode is performed.

On the other hand, when the operation mode is the refrigerant amount determining mode (S3: YES), the above-mentioned refrigerant amount determining operation is performed to acquire the current degree of subcooling SCp (S4). Then, it is determined whether or not the storage unit 120 stores the reference value SCr of the degree of subcooling (S5). When the storage unit 120 does not store the reference value SCr (S5: NO), the storage unit 120 stores the current degree of subcooling SCp as the reference value SCr of the degree of subcooling (S6). In this case, it is determined that the refrigeration cycle apparatus 10 enters the refrigerant amount determining mode for the first time after being installed, and the storage unit 120 stores the degree of subcooling in this case as the reference value SCr. After that, the operation mode is switched to the normal operation mode (S7), and this processing is finished.

On the other hand, when the storage unit 120 stores the reference value SCr (S5: YES), that is, the refrigeration cycle apparatus 10 enters the refrigerant amount determining mode for the second or subsequent time, it is determined whether or not the current degree of subcooling SCp is equal to or lower than the reference value SCr (S8).

Then, when the current degree of subcooling SCp is equal to or lower than the reference value SCr (S8: YES), processing is performed to, for example, indicate a warning representing less refrigerant amount on a remote control of the refrigeration cycle apparatus 10, an LED provided on the heat source unit 301, a remote monitor, or the like (S9). After that, the operation mode is switched to the normal operation mode (S7), and this processing is finished.

As described above, the period to enter the refrigerant amount determining mode is limited to a period with a small air conditioning load. Thus, whether or not the refrigerant amount is appropriate can be determined without disturbing the comfortability of the user. Further, the period to enter the refrigerant amount determining mode is limited to the cooling season start period and the heating season start period. Thus, when the refrigerant is leaking, operations such as repair and adding refrigerant are possible prior to the period in which the air-conditioning apparatus is fully required, improving the comfortability. Further, as described above, at the start of the normal operation, the operation mode is switched depending on the condition. Thus, the refrigeration cycle apparatus 10 is not operated when the air conditioning is not required, such as at night or on holidays, lowering power consumption. Further, the frequency of performing the refrigerant amount determining mode can be reduced, lowering power consumption.

The embodiment is described above with reference to the drawings, but the specific configuration is not limited thereto, and can be changed without departing from the gist of the invention. For example, in the above-mentioned embodiment, a case where the present invention is applied to the refrigeration cycle apparatus 10 switchable between cooling and heating is described as an example, but the present invention is not limited thereto. The present invention may be applied to a refrigeration cycle apparatus dedicated for heating, a refrigeration cycle apparatus dedicated for cooling, or a refrigeration cycle apparatus capable of operating for cooling and heating simultaneously. Further, the present invention may be applied to a small refrigeration cycle apparatus such as a home-use room air-conditioning apparatus or refrigerator, or a large refrigeration cycle apparatus such as a freezer for cooling in a refrigerated warehouse or a heat pump chiller.

Further, the operation of the refrigerant amount determining mode is not limited to that described in the above-mentioned embodiment, and various methods can be used instead. For example, in the above-mentioned embodiment, the degree of subcooling SC is described as the operation state amount representing the refrigerant amount as an example, but the present invention is not limited thereto. A temperature efficiency SC/dTc representing the heat exchange efficiency at the liquid phase part of the condenser may be used. In this case, dTc is a value obtained by subtracting the condenser suction air temperature Tao from the condensing temperature Tc. The condenser suction air temperature Tao is an indoor temperature detected by the indoor temperature sensor 206, for example. In general, the refrigerant density is increased as the mass velocity of the refrigerant is decreased, and hence the temperature efficiency is increased as the mass velocity of the refrigerant is decreased. Thus, the temperature efficiency is increased as the refrigerant density is increased, and hence the temperature efficiency SC/dTc at the liquid phase part may be used as the operation state amount representing the refrigerant amount, that is, the refrigerant density.

Further, in the above-mentioned embodiment, a case where the present invention is applied to the refrigeration cycle apparatus 10 performing a heating operation is described as an example, but the present invention may be applied in the cooling operation in which the use-side heat exchanger 7 serves as the evaporator and the heat source-side heat exchanger 3 serves as the condenser, to thereby determine the refrigerant amount. In this case, as compared to the case of the heating operation, a two-phase refrigerant is present in the liquid connecting pipe 6, and hence the error in the refrigerant density is increased, and when the pipe length is increased, the detection accuracy is slightly decreased. However, it can be determined whether or not the refrigerant amount filled in the refrigerant circuit is appropriate.

Further, in the above-mentioned embodiment, the operation mode is switched to the refrigerant amount determining mode under such conditions that the outside air temperature is within a specific temperature range and that it is immediately after the switching from the heating to the cooling or from the cooling to the heating, but the present invention is not limited thereto. For example, the operation mode may be switched to the refrigerant amount determining mode when at least one of these conditions is satisfied. For example, as shown in FIG. 8 and FIG. 9, the air conditioning load is small not only in the cooling and heating start periods but also in cooling and heating end periods. Thus, even in a case other than immediately after the switching from the cooling and the heating, the operation mode may be switched to the refrigerant amount determining mode based on the outside air temperature Ta. In this case, services can be executed during a period in which air conditioning is unnecessary after the end periods of the cooling and the heating. Further, when time and date are set on the remote control or the like, whether or not the set time and date is within the cooling start period or the heating start period, or whether or not it is a time period with a small air conditioning load (such as in the morning or evening) may be added to the conditions for switching to the refrigerant amount determining mode.

REFERENCE SIGNS LIST

1 compressor 2 flow switching device 3 heat source-side heat exchanger 4 outdoor air-sending device 5 expansion device 6 liquid connecting pipe 7 use-side heat exchanger 8 indoor air-sending device 9 gas connecting pipe 10 refrigeration cycle apparatus 100 controller

110 control unit 111 normal operation unit 112 refrigerant amount determining unit 113 mode switching unit 120 storage unit 130 notification unit 201 discharge temperature sensor 202 gas-side temperature sensor 203 outside air temperature sensor 204 liquid-side temperature sensor 205 liquid-side temperature sensor 206 indoor temperature sensor

207 gas-side temperature sensor 301 heat source unit 302 use unit

The invention claimed is:

1. A refrigeration cycle apparatus, comprising:

a refrigerant circuit connecting a compressor, a heat source-side heat exchanger, an expansion device, and a use-side heat exchanger to each other by connecting pipes;

an outside air temperature sensor configured to detect an outside air temperature; and a controller configured to operate the refrigeration cycle apparatus and to switch between a normal operation mode for controlling the refrigerant circuit based on an operation load of the use-side heat exchanger and a refrigerant amount determining mode for determining whether or not an amount of refrigerant in the refrigerant circuit is appropriate, the controller being configured to switch the normal operation mode to the refrigerant amount determining mode when the outside air temperature detected by the outside air temperature sensor is within a temperature range in which the normal operation of the refrigeration cycle apparatus can be performed at 50% or less of an air conditioning capacity of the refrigeration cycle apparatus.

2. The refrigeration cycle apparatus of claim 1, further comprising a flow switching device configured to switch a flow passage of refrigerant flowing out from the compressor, wherein, in the normal operation mode, the controller controls the flow switching device to switch between a heating operation and a cooling operation.

3. The refrigeration cycle apparatus of claim 2, wherein, when the heating operation is performed and the outside air temperature detected by the outside air temperature sensor is from 10 degrees C. to 15 degrees C., the controller switches the normal operation mode to the refrigerant amount determining mode.

4. The refrigeration cycle apparatus of claim 2, wherein, when the cooling operation is performed and the outside air temperature detected by the outside air temperature sensor is from 15 degrees C. to 25 degrees C., the controller switches the normal operation mode to the refrigerant amount determining mode.

5. The refrigeration cycle apparatus of claim 2, wherein, when the heating operation is performed and a previous operation is the cooling operation, or when the cooling operation is performed and the previous operation is the heating operation, the controller determines whether or not the outside air temperature is within the set temperature range.

6. The refrigeration cycle apparatus of claim 1, further comprising a storage unit configured to store, as a reference value, an operation state amount of the refrigerant circuit when the normal operation mode is switched to the refrigerant amount determining mode for a first time, and wherein, in the refrigerant amount determining mode, the controller compares the reference value stored in the storage unit with a current operation state amount.

7. The refrigeration cycle apparatus of claim 6, wherein the operation state amount is a degree of subcooling.

8. The refrigeration cycle apparatus of claim 6, further comprising a temperature sensor configured to detect a temperature of air subjected to heat exchange at the use-side heat exchanger, wherein the operation state amount is obtained by dividing a degree of subcooling by a value obtained by subtracting the temperature of the air from a condensing temperature obtained when the use-side heat exchanger functions as a condenser.

9. The refrigeration cycle apparatus of claim 6, further comprising a liquid temperature detecting sensor configured to detect, when the use-side heat exchanger functions as a condenser, a liquid temperature at an outlet of the condenser, wherein, in the refrigerant amount determining mode, the controller controls a rotation speed of the compressor so that a condensing temperature is a target value based on the liquid temperature.

10. The refrigeration cycle apparatus claim 6, wherein, in the refrigerant amount determining mode, the controller sets a target value of a degree of suction superheat of the compressor based on the outside air temperature detected by the outside air temperature sensor.

* * * * *